US009943711B2

(12) United States Patent
Losos et al.

(10) Patent No.: US 9,943,711 B2
(45) Date of Patent: Apr. 17, 2018

(54) TANK ATTACHMENT ARRANGEMENT FOR A SELF-CONTAINED BREATHING APPARATUS

(71) Applicant: Mine Safety Appliances Company, Cranberry, PA (US)

(72) Inventors: David J. Losos, Evans City, PA (US); Stephen J. Denninger, Pittsburgh, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 395 days.

(21) Appl. No.: 14/141,550

(22) Filed: Dec. 27, 2013

(65) Prior Publication Data

US 2015/0144137 A1 May 28, 2015

Related U.S. Application Data

(60) Provisional application No. 61/909,482, filed on Nov. 27, 2013.

(51) Int. Cl.
*A62B 9/04* (2006.01)
*A62B 25/00* (2006.01)

(52) U.S. Cl.
CPC ..... *A62B 9/04* (2013.01); *A62B 25/00* (2013.01)

(58) Field of Classification Search
CPC ..... A62B 9/04; A62B 25/00; A62B 18/006; A62B 35/0025; A62B 7/02; A62B 7/10; A62B 9/006; A61M 16/0051; A61M 16/10; A61M 2016/0027; A61M 2016/0036; A61M 2202/0208; A61M 2205/502; A61M 2205/584; A61M 2205/8206; A61M 2209/086; A61M 2230/432; A62C 13/78; B60H 1/3229; B60R 11/00; B63B 21/56; B63C 11/02; B63C 11/08; B63C 11/18; B63C 11/22; B63C 11/30; B63C 2011/024; B63C 2011/026; B63C 2011/2281; B63C 2011/306; F17C 13/084; F17C 2201/0109; F17C 2201/0119; F17C 2201/058; F17C 2205/0107; F17C 2205/0165; F17C 2205/018; F17C 2270/0781; Y10S 224/934
(Continued)

(56) References Cited

U.S. PATENT DOCUMENTS 3,090,205 A * 5/1963 Hurwitz et al. ..... 405/186
4,125,240 A * 11/1978 Heard ..... 248/218.4
(Continued)

FOREIGN PATENT DOCUMENTS

EP 1516811 A2 3/2005

*Primary Examiner* — Annette Dixon
(74) *Attorney, Agent, or Firm* — The Webb Law Firm

(57) ABSTRACT

A tank attachment arrangement for a self-contained breathing apparatus having at least one tank, including: a base member having a saddle portion comprising a contact side having at least one contact member directly or indirectly attached thereto, the at least one contact member configured to contact a surface of the at least one tank; and at least one tank retainer arrangement configured to retain the at least one tank with respect to the base member; wherein the at least one contact member includes at least one sloped portion to facilitate engagement or disengagement of the at least one tank with the tank attachment arrangement.

22 Claims, 12 Drawing Sheets

(58) Field of Classification Search
USPC ..... 128/205.22, 200.24, 201.22, 204.18; 248/313, 346.01, 154, 213.2, 220.21, 248/221.11, 224.7, 229.17, 307, 310, 248/311.2, 3, 13, 316.4, 316.5, 544, 74.3; 211/71.01, 88.01; 410/47, 49; 294/15, 294/151, 165, 169, 31.2; 114/315, 343, 114/364
See application file for complete search history.

(56) References Cited

U.S. PATENT DOCUMENTS

| | | | | | |
|---|---|---|---|---|---|
| 4,304,383 | A * | 12/1981 | Huston | A62C 13/78 | 248/313 |
| 4,832,398 | A * | 5/1989 | Tecca | B63C 11/22 | 294/151 |
| 4,952,095 | A * | 8/1990 | Walters | B63C 11/08 | 114/315 |
| 7,331,553 | B2 * | 2/2008 | Kling et al. | 248/313 | |
| 2006/0175492 | A1 * | 8/2006 | Cooper | A62B 9/04 | 248/229.17 |
| 2008/0257928 | A1 | 10/2008 | Lowry et al. | | |
| 2010/0313394 | A1 | 12/2010 | Busch | | |
| 2013/0247912 | A1 | 9/2013 | Loser et al. | | |

* cited by examiner

TANK ATTACHMENT ARRANGEMENT FOR A SELF-CONTAINED BREATHING APPARATUS

CROSS REFERENCE TO RELATED APPLICATIONS

This application claims benefit of priority from U.S. Provisional Patent Application No. 61/909,482, filed Nov. 27, 2013, which is incorporated herein by reference in its entirety.

BACKGROUND OF THE INVENTION

Field of the Invention

The present invention relates generally to self-contained breathing apparatuses and systems that provide regulated gas, e.g., air or oxygen, from one or more tanks or cylinders to a user, and in particular to a tank attachment arrangement for facilitating the removable attachment of a tank or tanks to a back-plate assembly of a self-contained breathing apparatus.

Description of the Related Art

As is known in the art, a variety of activities, workplace functions, and emergency situations require additional safety measures and systems. In particular, such activities, functions, and situations include, without limitation, industrial or manufacturing activities, construction activities, firefighting and rescue activities, activities that pose a potential risk to the person or persons involved, contaminated environment situations, and even leisure activities (e.g., diving), and the like. Providing safety equipment to those involved in such activities and environments is required, and in certain situations such protection includes the required use of a self-contained breathing apparatus.

A self-contained breathing apparatus may take a variety of forms and configurations. In one typical configuration, the self-contained breathing apparatus includes a back-plate assembly with an attachment system, e.g., adjustable straps, a harness, and the like, on one side for removably attaching the back-plate assembly to the user. On the other side of the back-plate assembly, a tank attachment arrangement is provided, which facilitates the removable attachment of one or more tanks or cylinders, e.g., air tanks, oxygen tanks, and the like, to the assembly. In addition, a regulation system is attached to or integrated with the back-plate assembly and configured to deliver regulated gas from the tank to the user, typically to a mask worn by the user. In this manner, the user may operate effectively in hazardous or low- or no-oxygen environments and situations.

One such tank attachment arrangement is shown and described in U.S. Pat. No. 7,331,553, entitled "Bottle Support of Compressed-Air Bottles", the contents of which are incorporated herein by reference. In the '553 patent, the tank attachment arrangement includes a bottle support (4) attached to a support frame (5), which is part of the back-plate assembly. The bottle support (4) includes multiple glide inserts (3) that project from the surface (9) of the bottle support (4). In operation, a bottle (1) is placed in the bottle support (4) and a tightening strap (6) is used to urge the bottle (1) against the glide inserts (3), which compress into the hollow spaces (10) to allow the bottle (1) to contact the surface (9). These glide inserts (3) (and the adjacent portions of the bottle support (4)) are resilient and, when the strap (6) is loosened, the glide inserts (3) protrude and slightly lift the bottle (1) and release it from the frictional forces of the bottle support (4). Accordingly, the bottle support (4) of the '553 patent provides for the positioning and removal of a tank or cylinder in a tank attachment arrangement of a self-contained breathing apparatus. However, there is room for further improvements in this area, particularly with respect to the ability to quickly and effectively attach and remove a tank to and from the back-plate assembly.

Accordingly, there is a need in the art for improved tank attachment arrangements for use in connection with a self-contained breathing apparatus.

SUMMARY OF THE INVENTION

Generally, provided is a tank attachment arrangement for a self-contained breathing apparatus that provides for an improved tank or cylinder connection arrangement in SCBA systems and configurations. Preferably, provided is a tank attachment arrangement for a self-contained breathing apparatus that facilitates quick attachment and removal of a tank to and from a back-plate assembly of the self-contained breathing apparatus. Preferably, provided is a tank attachment arrangement for a self-contained breathing apparatus that provides a low-friction interface for the insertion and removal of the tank to and from the tank attachment arrangement. Preferably, provided is a tank attachment arrangement for a self-contained breathing apparatus that facilitates the proper positioning of the tank in connection with the tank attachment arrangement.

In one preferred and non-limiting embodiment, provided is a tank attachment arrangement for a self-contained breathing apparatus having at least one tank, including: a base member having a saddle portion comprising a contact side having at least one contact member directly or indirectly attached thereto, the at least one contact member configured to contact a surface of the at least one tank; and at least one tank retainer arrangement configured to retain the at least one tank with respect to the base member. The at least one contact member includes at least one sloped portion to facilitate engagement or disengagement of the at least one tank with the tank attachment arrangement.

In another preferred and non-limiting embodiment, provided is a tank attachment arrangement for use in connection with a self-contained breathing apparatus having a back-plate assembly configured to be removably attached to a user and at least one tank having gas therein. The tank attachment arrangement includes: a base member having a saddle portion comprising a contact side having at least one contact member directly or indirectly attached thereto, the at least one contact member configured to contact a surface of the at least one tank; and at least one tank retainer arrangement configured to retain the at least one tank with respect to the base member. The at least one contact member includes at least one sloped portion to facilitate engagement or disengagement of the at least one tank with the tank attachment arrangement.

In a still further preferred and non-limiting embodiment, provided is a self-contained breathing apparatus, including: a back-plate assembly having at least one attachment arrangement configured to removably connect the back-plate assembly to a user; at least one tank having gas therein; a regulation system directly or indirectly connected to the at least one tank and configured to provide regulated gas from the tank to a mask of the user; and a tank attachment arrangement. The tank attachment arrangement includes: a base member having a saddle portion comprising a contact side having at least one contact member directly or indirectly attached thereto, the at least one contact member configured to contact a surface of the at least one tank; and at least one tank retainer arrangement configured to retain the at least one tank with respect to the base member. The at least one contact member includes at least one sloped portion to facilitate engagement or disengagement of the at least one tank with the tank attachment arrangement.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
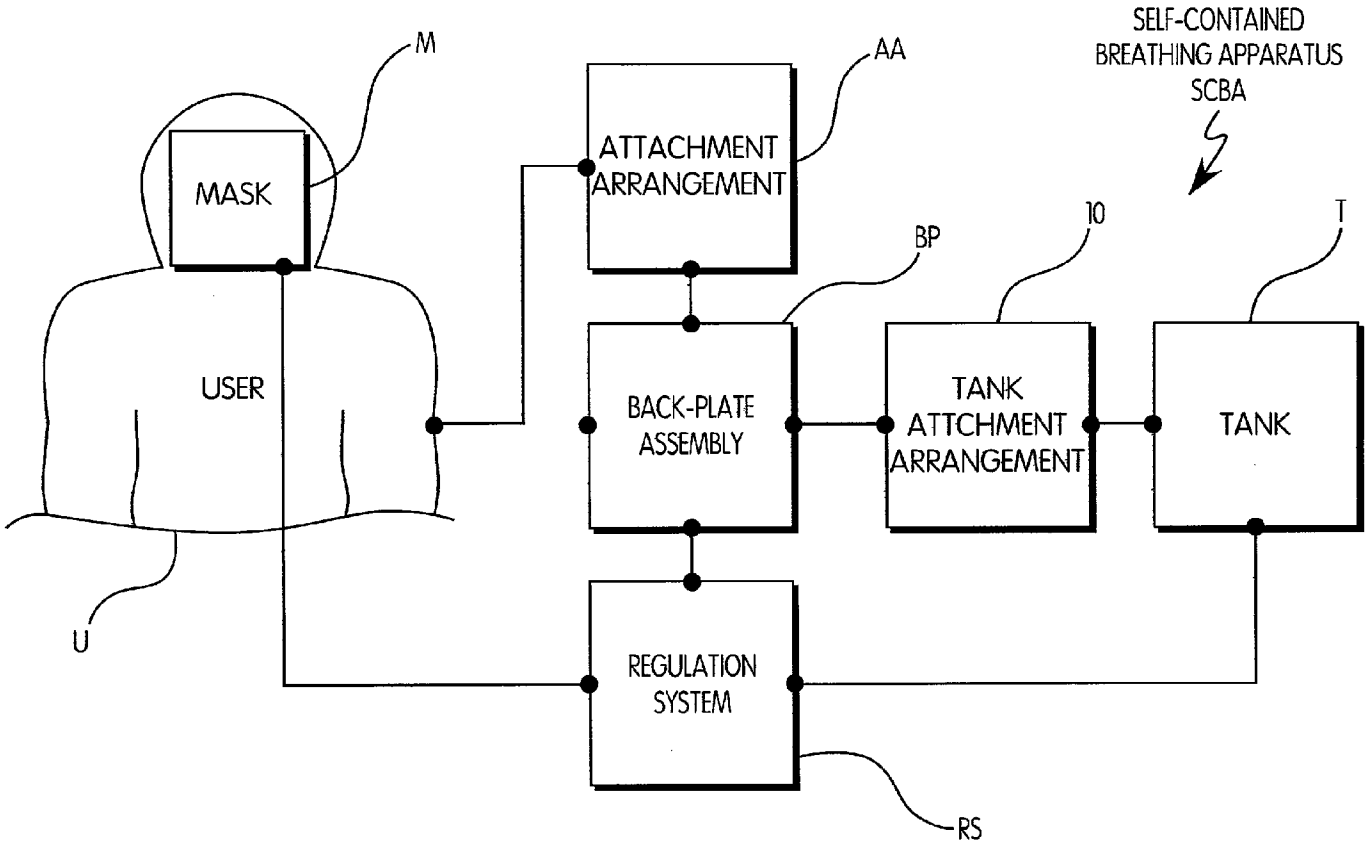
FIG. 1 is a schematic view of a self-contained breathing apparatus including a tank attachment arrangement according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to a tank attachment arrangement 10 for use in connection with a self-contained breathing apparatus (SCBA). As illustrated in schematic form in FIG. 1, the self-contained breathing apparatus (SCBA) represents an assembly or a unit that is removably attachable to a user (U), as discussed above. In particular, and with continued reference to FIG. 1, the self-contained breathing apparatus (SCBA) includes a back-plate assembly (BP) that serves as the platform or frame upon which other components are attached, integrated, or connected. In this embodiment, the back-plate assembly (BP) includes an attachment arrangement (AA) that facilitates the removable attachment of the back-plate assembly (BP) to the user (U). The attachment arrangement (AA) may be in the form of straps, a harness, or other adjustable members that allow the user (U) to quickly and effectively don and/or remove the self-contained breathing apparatus SCBA. The self-contained breathing apparatus (SCBA) also includes one or more tanks (T), which include or are filled with gas, typically air or oxygen, which is provided to a mask (M) of the user (U) through a regulation system (RS). In order to attach and/or hold the tank (T) with respect to the back-plate assembly (BP), the presently-invented tank attachment arrangement 10 is utilized. Certain preferred and non-limiting embodiments of this tank attachment arrangement 10 (including its components, as a separate unit or assembly, and positioned with respect to the self-contained breathing apparatus (SCBA)) are illustrated in FIGS. 2-12.

With reference to FIGS. 2-5, and in one preferred and non-limiting embodiment, the tank attachment arrangement 10 includes a base member 12 having a saddle portion 14 with a contact side 16. The contact side 16 of the saddle portion 14 also includes at least one, and preferably multiple, contact members 18 directly or indirectly attached thereto. In particular, the contact members 18 may be permanently attached to the saddle portion 14 (or any other portion of the base member 12), or alternatively, removably attached thereto. Further, the contact members 18 are sized, shaped, or configured to contact or bear against a surface of the tank (T).

In this embodiment, the tank attachment arrangement 10 also includes a tank retainer arrangement 20 that is configured to retain the tank (T) with respect to the base member 12. As discussed in further detail hereinafter, the tank retainer arrangement 20 is typically in the form of an elongate band or strap that, with some adjustment and/or tensioning mechanism, allows for the attachment and detachment of the tank (T) with respect to base member 12, where the tank (T) is urged against the contact members 18 and contact side 16 of the saddle portion 14. Further, in this embodiment, the contact members 18 include at least one sloped portion 22 which serves to facilitate quick and effective engagement or disengagement of the tank (T) with the tank attachment arrangement 10.

As illustrated in FIGS. 2-5, and in one preferred and non-limiting embodiment, the saddle portion 14 includes two contact members 18, which are sized, shaped, or angled to contact the surface of the tank (T) substantially simultaneously upon insertion of or attachment of the tank (T) to or within the tank attachment arrangement 10. In particular, and in this embodiment, by using two, spaced contact members 18 on the contact side 16 of the saddle portion 14, the tank (T) will be automatically centered or aligned with respect to the base member 12 and the tank retainer arrangement 20. Such an arrangement facilitates quick positioning of the tank (T) and the tank attachment arrangement 10, thereby providing a simple and effective tank (T) changing process. Also, and based upon the use of the sloped portion 22, as discussed in greater detail hereinafter, the tank (T) is provided with a low-friction insertion operation, since the surface of the tank (T) will easily glide or move up along the sloped portion 22 of each contact member 18 and along the contact side 16 of the saddle portion 14.

Figure 2:
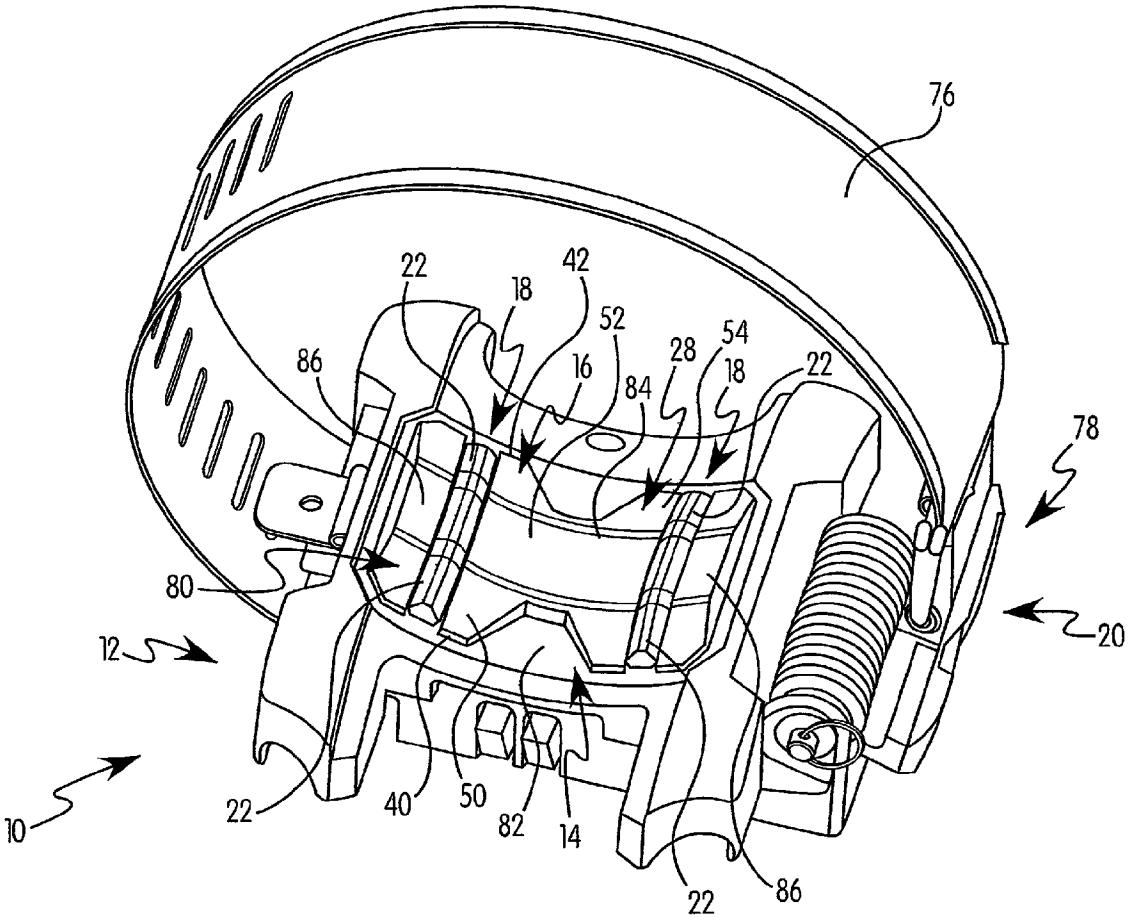
FIG. 2 is a perspective view of one embodiment of a tank attachment arrangement for a self-contained breathing apparatus according to the principles of the present invention.
Figure 3:
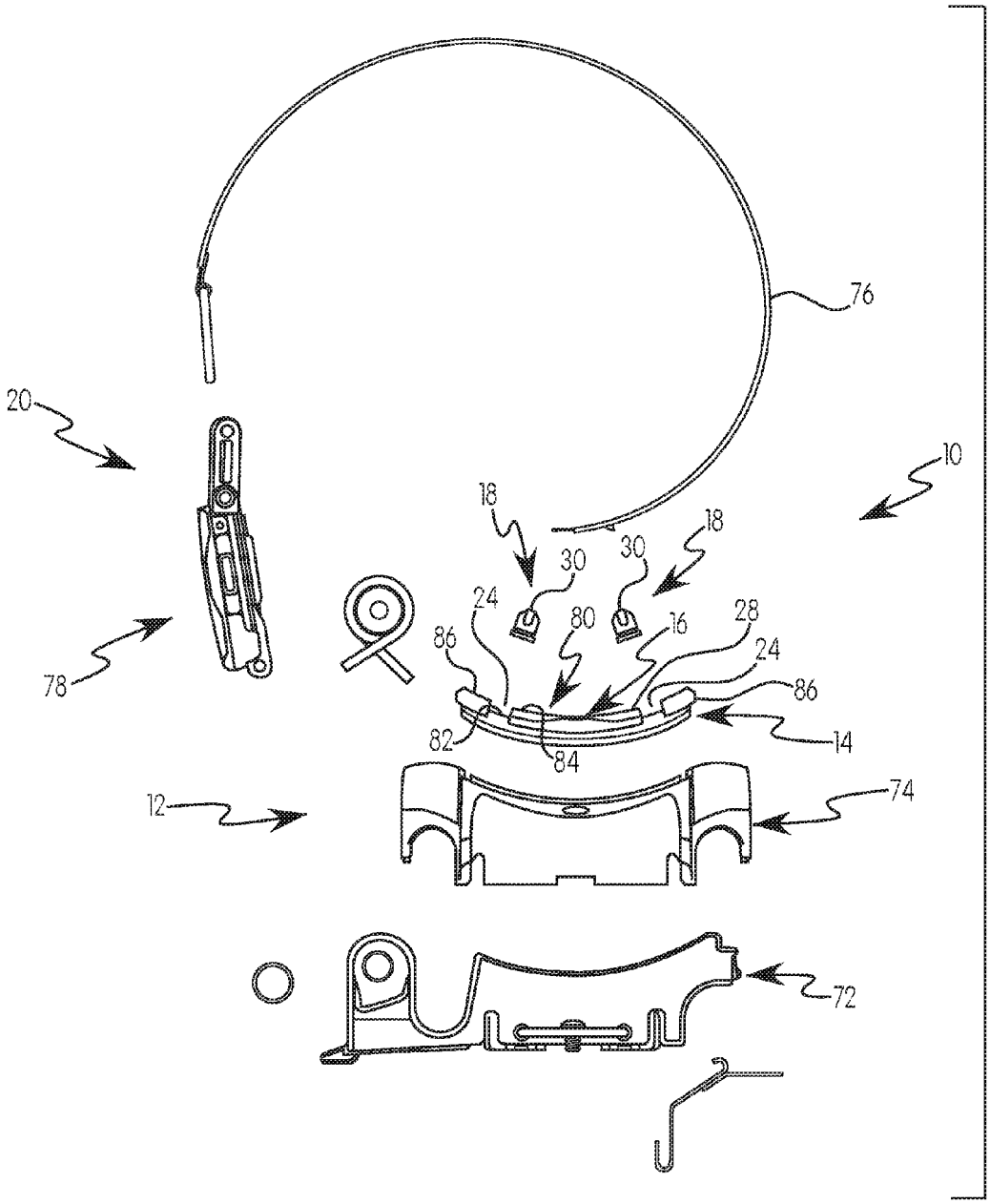
FIG. 3 is an exploded edge view of the tank attachment arrangement of FIG. 2.
Figure 4:
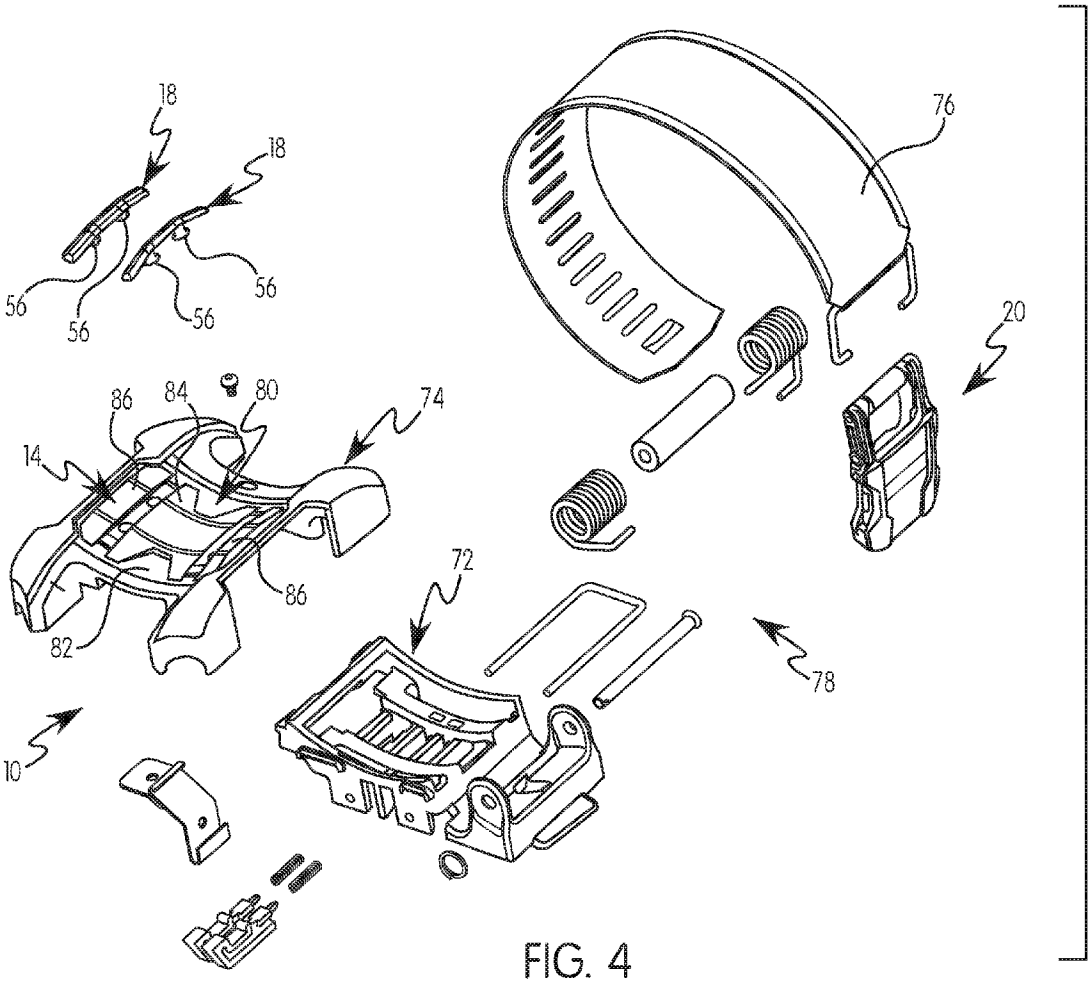
FIG. 4 is an exploded perspective view of the tank attachment arrangement of FIG. 2.
Figure 5:
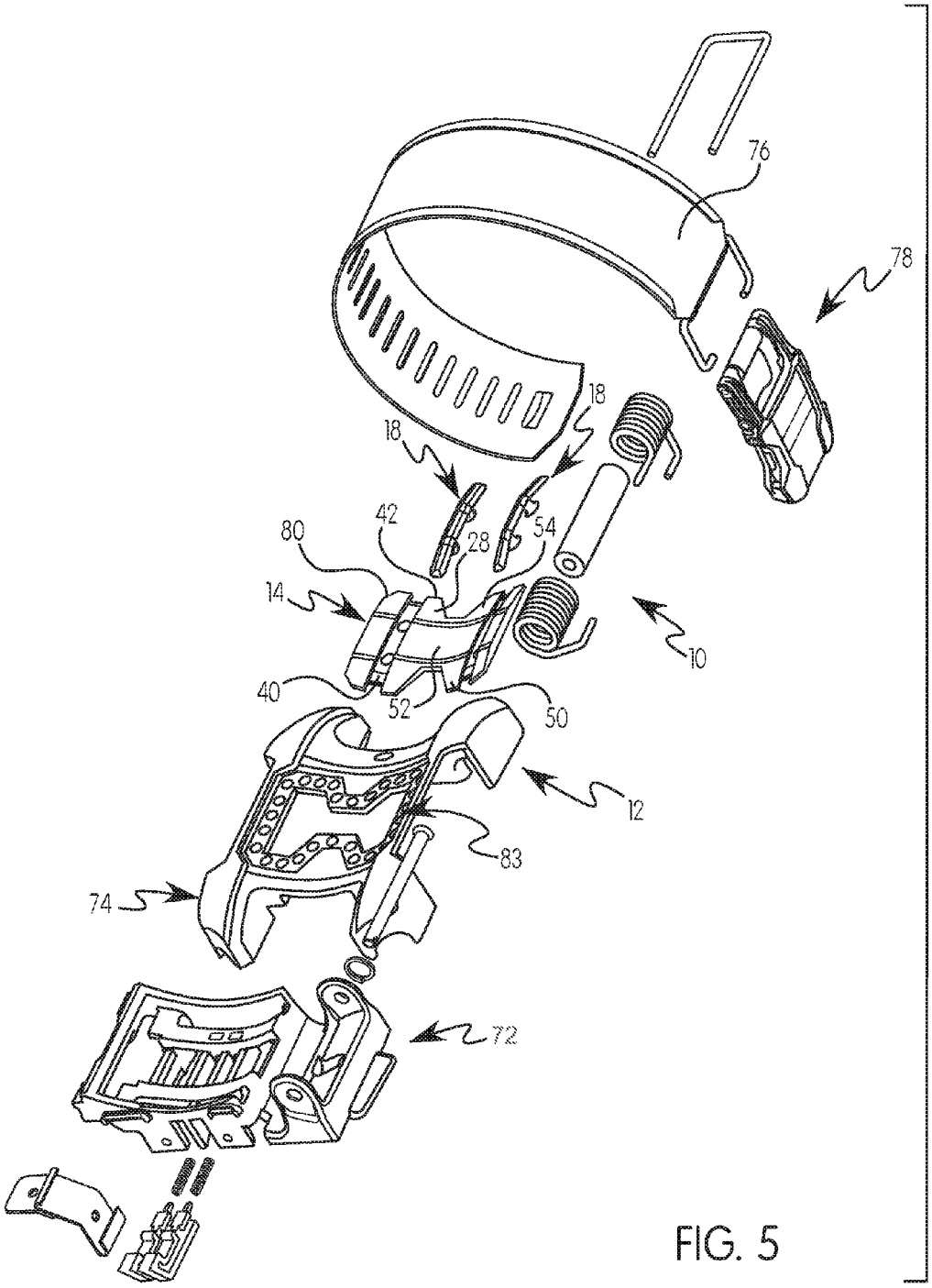
FIG. 5 is an exploded perspective view of the tank attachment arrangement of FIG. 2.
Figure 6:
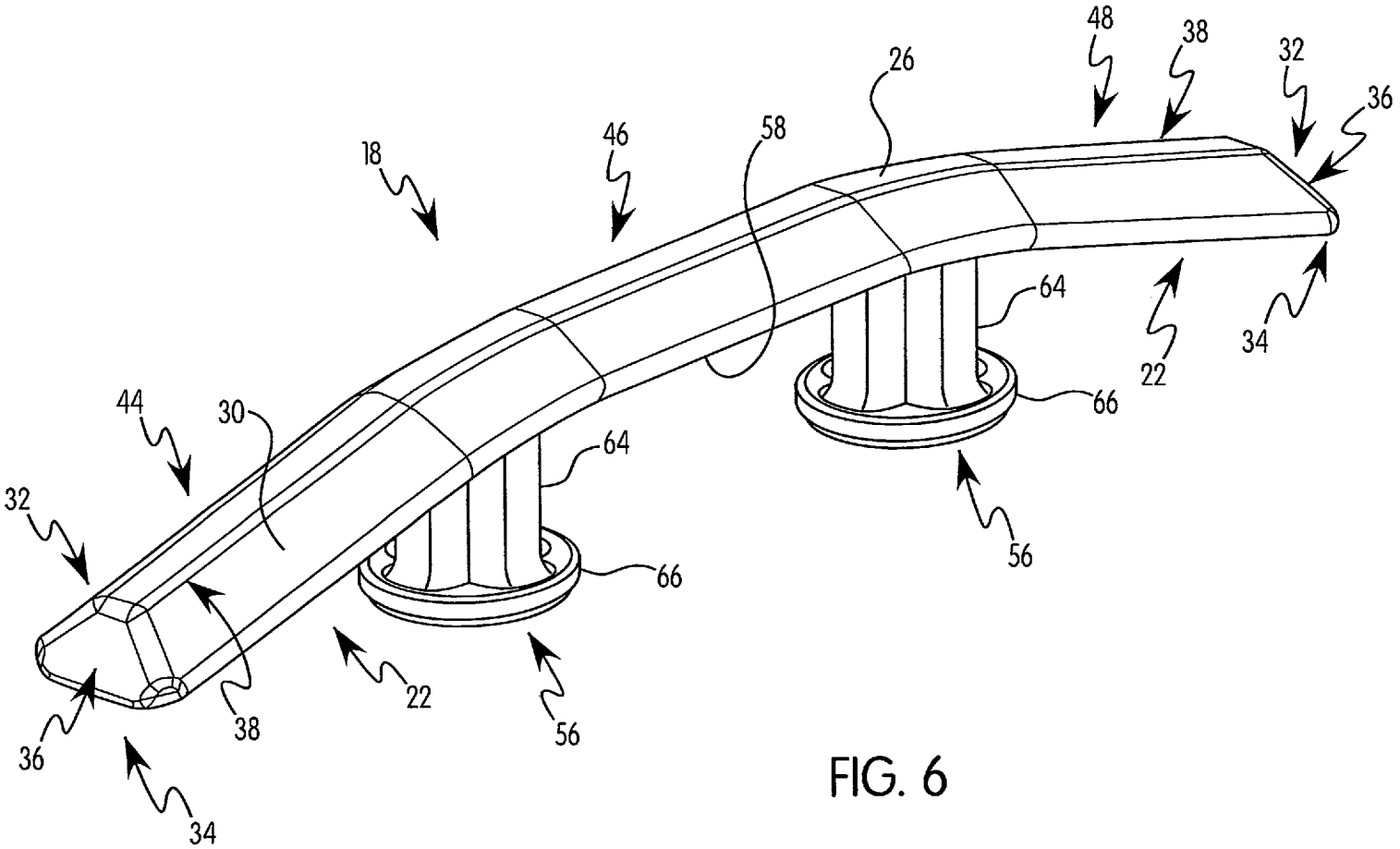
FIG. 6 is a perspective view of a contact member of the tank attachment arrangement of FIG. 2.
Figure 7:
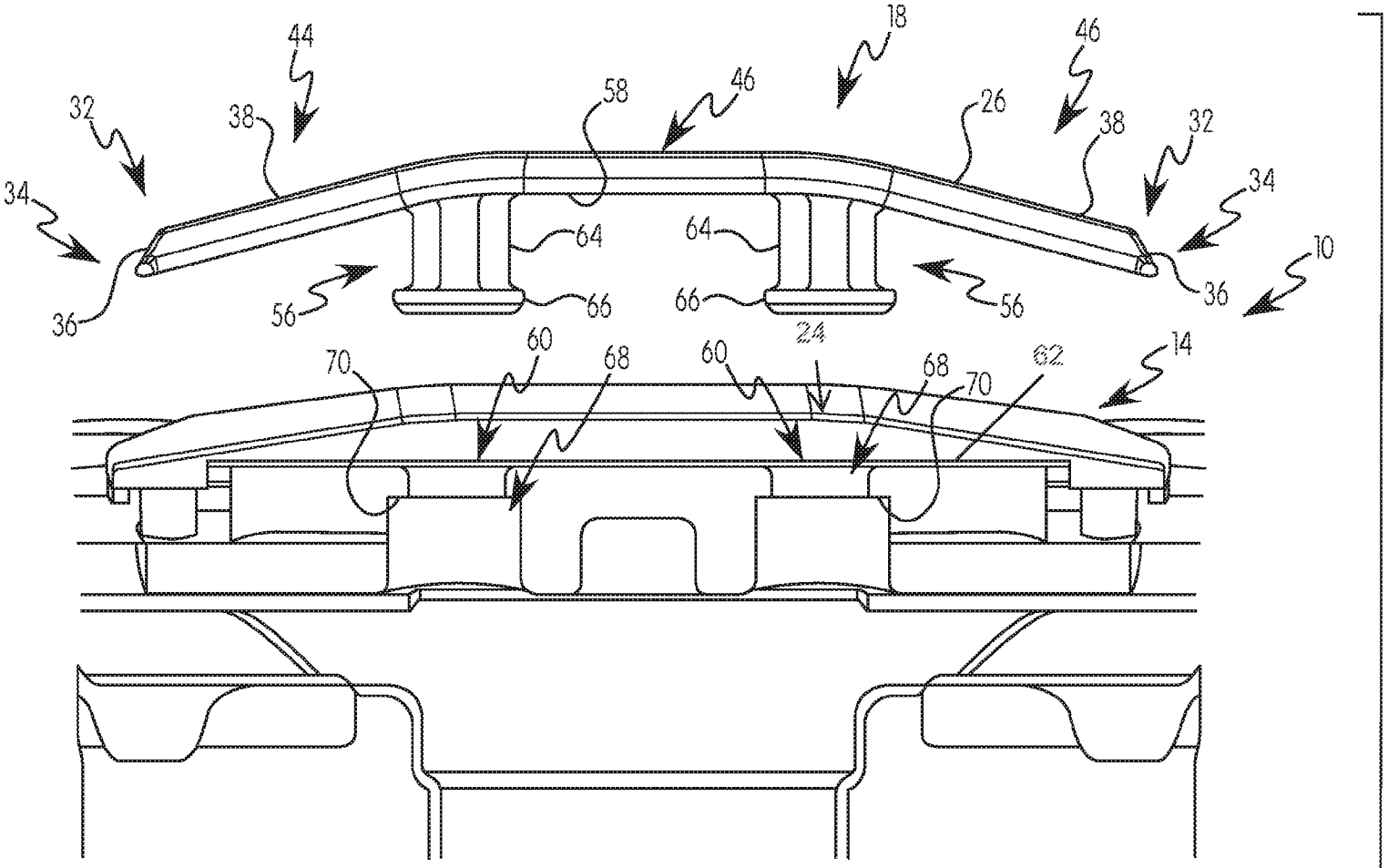
FIG. 7 is an exploded sectional view of the tank attachment arrangement of FIG. 2.
Figure 8:
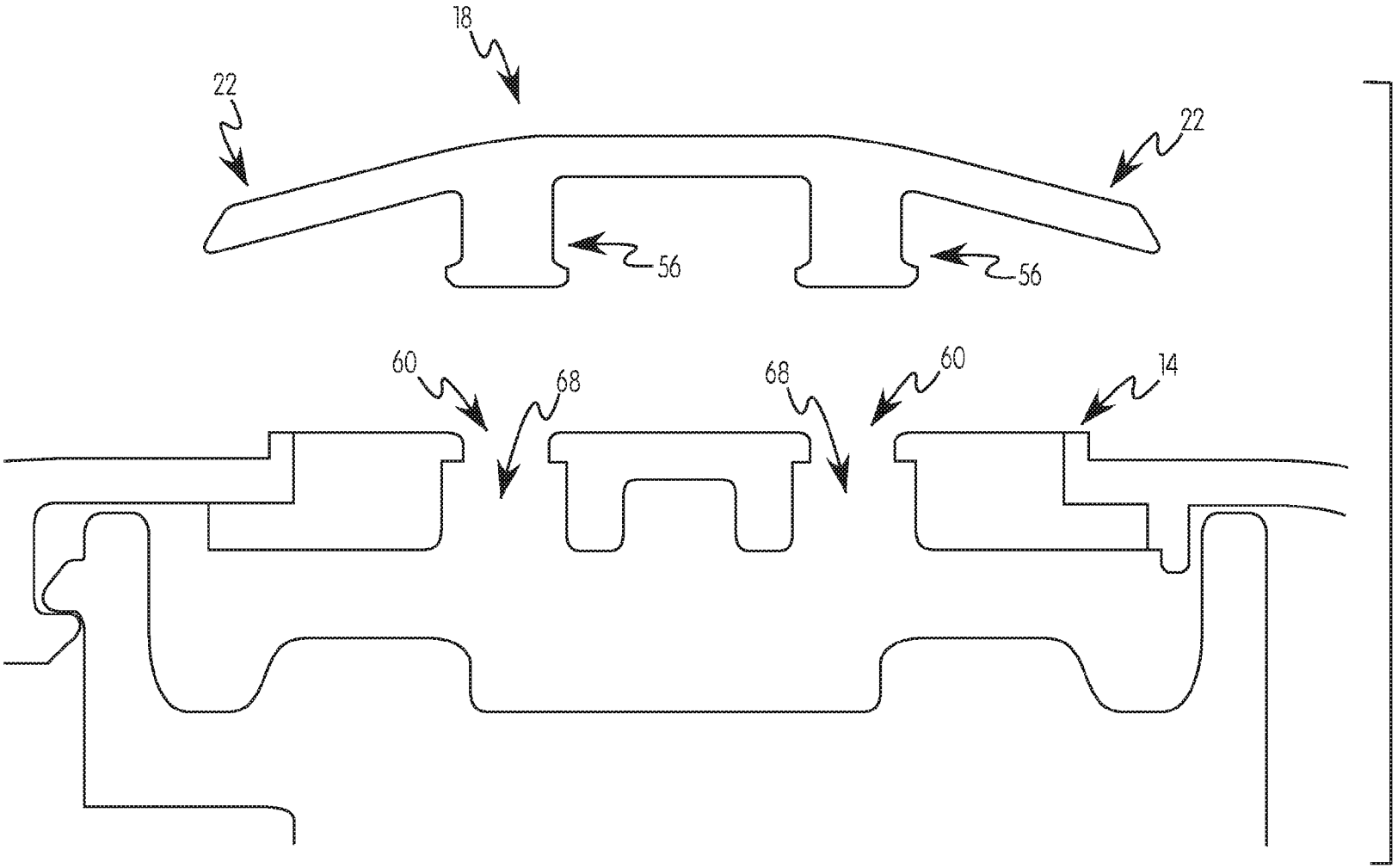
FIG. 8 is an exploded schematic view of the tank attachment arrangement of FIG. 7.

With reference to FIG. 3, and in another preferred and non-limiting embodiment, the contact member 18 is sized, shaped, or configured to be at least partially positioned in a groove 24 that extends along the contact side 16 of the saddle portion 14. As seen, and in this preferred and non-limiting embodiment, two grooves 24 are provided for receiving a respective contact member 18. Each contact member 18 is permanently or removably attached at least partially within a respective groove 24, such that a top surface 26 of each contact member 18 extends or projects beyond a top surface 28 of the contact side 16 of the saddle portion 14 (see FIG. 2). Further, and as best seen in FIGS. 2 and 6, the top surface 26 of the contact member 18 is shaped, rounded, or sloped to provide at least one side sloped portion 30. It is envisioned that this side sloped portion 30 of each contact member 18 may be part of a contact member 18 with a rounded cross section, a side of a contact member 18 with a substantially triangular cross section, a side of a contact member 18 with a truncated substantially triangular cross section, or any similar shape or configuration. In particular, it is this side sloped portion 30 of contact member 18 that provides (or assists in providing) the above-discussed centering capability and function of the tank (T) with respect to the base member 12. Similar shapes and sizes are envisioned to achieve this centering function, and are considered within the spirit and scope of the presently-invented tank attachment arrangement 10.

With continued reference to FIGS. 2, 3, and 6, and in another preferred and non-limiting embodiment, the sloped portion 22 of the contact member 18 is in the form of a tip area 32 of the contact member 18, where this tip area 32 includes a thickness at a distal end 34 that is less than or substantially equal to the depth of the groove 24 and/or the thickness of the saddle portion 14. Accordingly, the distal end 34 of the tip area 32 will not interfere with the movement of the tank (T) through and with respect to the tank retainer arrangement 20. This tip area 32 and sized distal end 34 thereof may also be used at both ends of the contact member 18. This would allow for the effective insertion of the tank (T) with respect to the tank retainer arrangement 20 from both a bottom-up movement and a top-down movement. Further, by using both the sloped portion 22 with the above-discussed tip area 32 and the side sloped portion 30, the tank (T) is easily and quickly insertable within or in connection with the tank retainer arrangement 20, and, at the same time, centered with respect to the base member 12.

As illustrated in the preferred and non-limiting embodiment of FIGS. 2 and 6, the sloped portion 22 of the contact member 18 includes a first sloped area 36 and a second sloped area 38. The first sloped area 36 and the second sloped area 38 include a different degree of slope, and in one preferred and non-limiting embodiment, the first sloped area 36 is coextensive with or in the form of the tip area 32 discussed above. By using different degrees of slope between the first sloped area 36 and the second sloped area 38, the tank (T) is easily urged upward (or downward) along the first sloped area 36 and then engaged with or bear against the second sloped area 38. As above, this combination of a first sloped area 36 and the second sloped area 38 may be formed or used on either or both ends of the contact member 18. In addition, additional sloped areas or rounded area may be used to achieve a substantially similar effect.

As seen in FIG. 2, and in another preferred and non-limiting embodiment, the contact member 18 extends substantially from a first edge 40 of the contact side 16 of the saddle portion 14 to a second edge 42 of the contact side 16 of the saddle portion 14. Again, if the various above-discussed sloped portions 22 are used on both ends of the contact member 18, the user (U) may attach the tank (T) to the tank attachment arrangement 10 from both above and below the tank attachment arrangement 10.

In another preferred and non-limiting embodiment, and as best illustrated in FIGS. 2 and 6-9, the contact member may include a first sloped portion 44 (which may be in the form of the above-discussed first sloped area 36 and second sloped area 38), a substantially linear portion 46, and a second sloped portion 48 (which may also include the above-discussed first sloped area 36 and second sloped area 38). In operation, the user (U) moves the tank (T) through the tank retainer arrangement 20 by first contacting or urging tank (T) along the first sloped portion 44 and along or in contact with the linear portion 46. Upon tightening of the tank retainer arrangement 20, the tank (T) is urged tighter against the linear portion 46 of each contact member 18, and in one preferred and non-limiting embodiment, against the first sloped portion 44 and second sloped portion 48, as well as the top surface 28 of the saddle portion 14. In this manner, the tank (T) is held securely with respect to the base member 12, and, thus, the back-plate assembly BP.

In another preferred and non-limiting embodiment, the contact member 18 is formed from an elastic material, a flexible material, a resilient material, a rubber material, a synthetic material, a low-friction material (e.g., a slippery material), a plastic material, and/or a silicon material. By using a flexible or resilient material, and when the tank (T) is urged against the contact member 18 using the tank retainer arrangement 20, the tank is gripped or held firmly in place with respect to the base member 12 (i.e., on the contact side 16 (or, as discussed hereinafter, on the saddle contact member 80) of the saddle portion 14). In addition, and in one preferred and non-limiting embodiment where two contact members 18 are provided, the use of this flexible or resilient material provides an additional gripping or securement feature.

In another preferred and non-limiting embodiment, and by using a silicon material or similar synthetic (e.g., low-friction or "slippery") material, the tank (T) "glides" along the contact member 18 and into position with respect to the base member 12. Accordingly, by using this low-friction material, together with the sloped portion 22 of the contact member 18, the tank (T) can be quickly and effectively attached to the back-plate assembly BP using the tank attachment arrangement 10. In addition, and by using such a low-friction material in the embodiment with two (or multiple) contact members 18, the above-discussed centering function occurs in a more effective manner. It should also be noted that multiple contact members 18 can be used and positioned in a variety of systems and configurations of a self-contained breathing apparatus (SCBA), regardless of how many tanks T are used in the system.

As seen in FIGS. 2 and 3, and in another preferred and non-limiting embodiment, the contact side 16 of the saddle portion 14 is substantially concave. In addition, the contact side 16 of the saddle portion 14 includes a first sloped portion 50, a substantially linear portion 52, and a second sloped portion 54. Accordingly, the shape of the contact side 16 of the saddle portion 14 may be substantially similar to the above-discussed shape of the contact member 18. It is also envisioned that the contact side 16 of the saddle portion 14 may be rounded or otherwise shaped to work in conjunction with the shape of the contact member 18. In this embodiment, and upon engagement of a tank (T) with the tank retainer arrangement 20, once urged against the contact side 16 of the saddle portion 14, the tank (T) primarily contacts the linear portion 52 of the saddle portion 14 (together with the linear portion 46 of the contact member 18).

With reference to FIGS. 6-9, and in another preferred and non-limiting embodiment, the contact member 18 includes at least one (and in one preferred and non-limiting embodiment, two) attachment extensions that project or extend from a bottom surface 58 of the contact member 18. In addition, the groove 24 includes at least one (or in one preferred and non-limiting embodiment, two) orifices 60 that extend through a bottom surface 62 of the groove 24. These orifices 60 (or conduits) are sized, shaped, or configured to at least partially receive and retain the attachment extension 56, such that the contact member 18 is attached to the saddle portion 14 of the base member 12.

Figure 9:
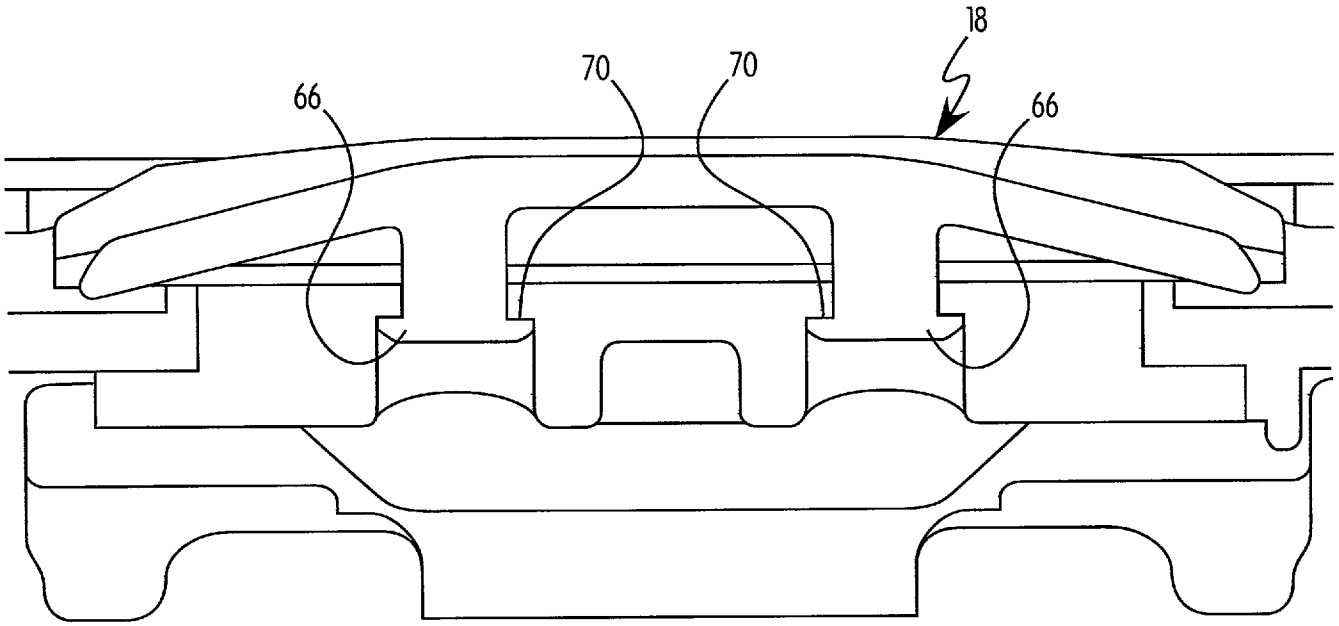
FIG. 9 is a side sectional view of the tank attachment arrangement of FIG. 7.
Figure 10:
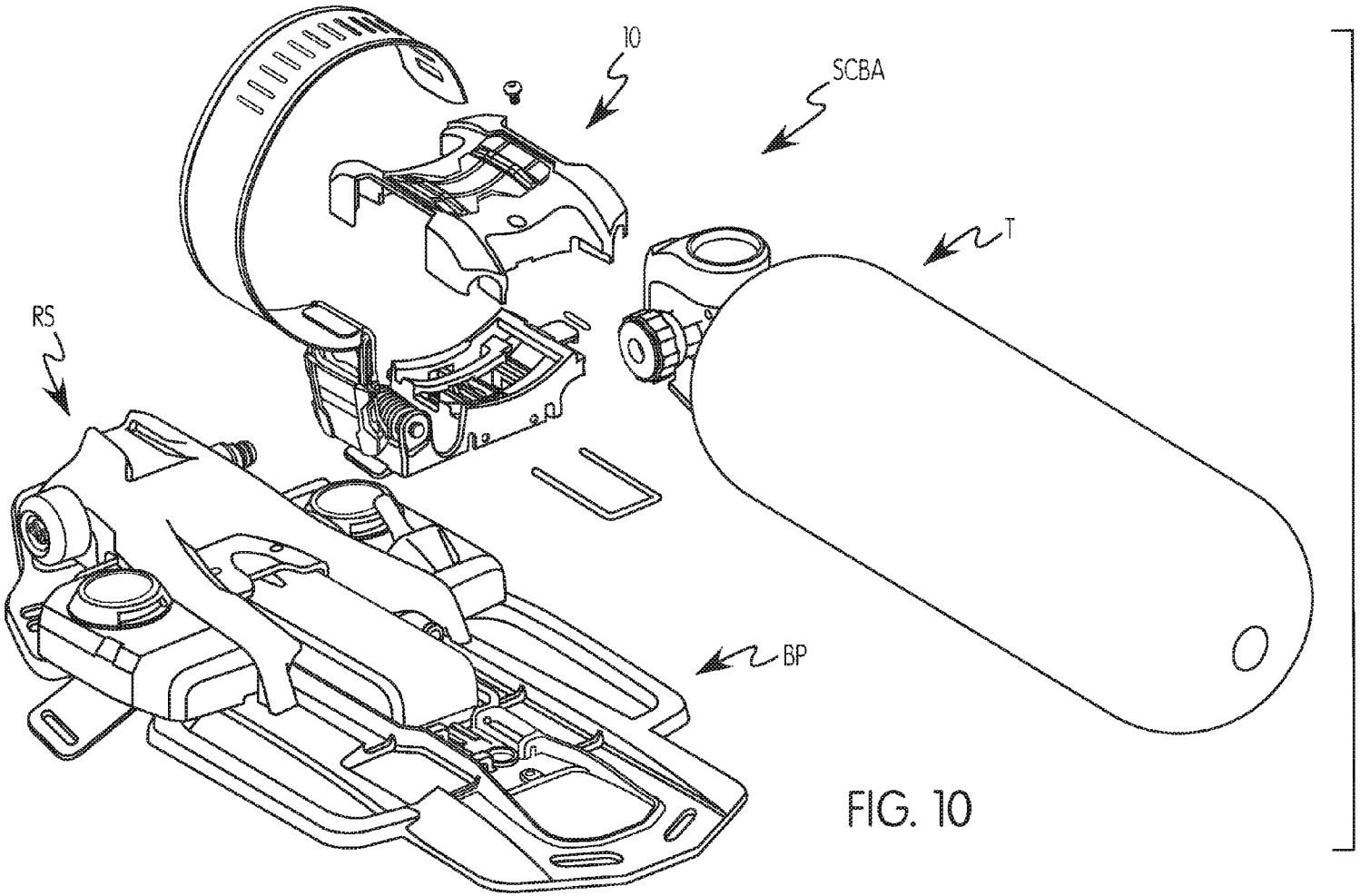
FIG. 10 is an exploded perspective view of a self-contained breathing apparatus including the tank attachment arrangement of FIG. 2.
Figure 11:
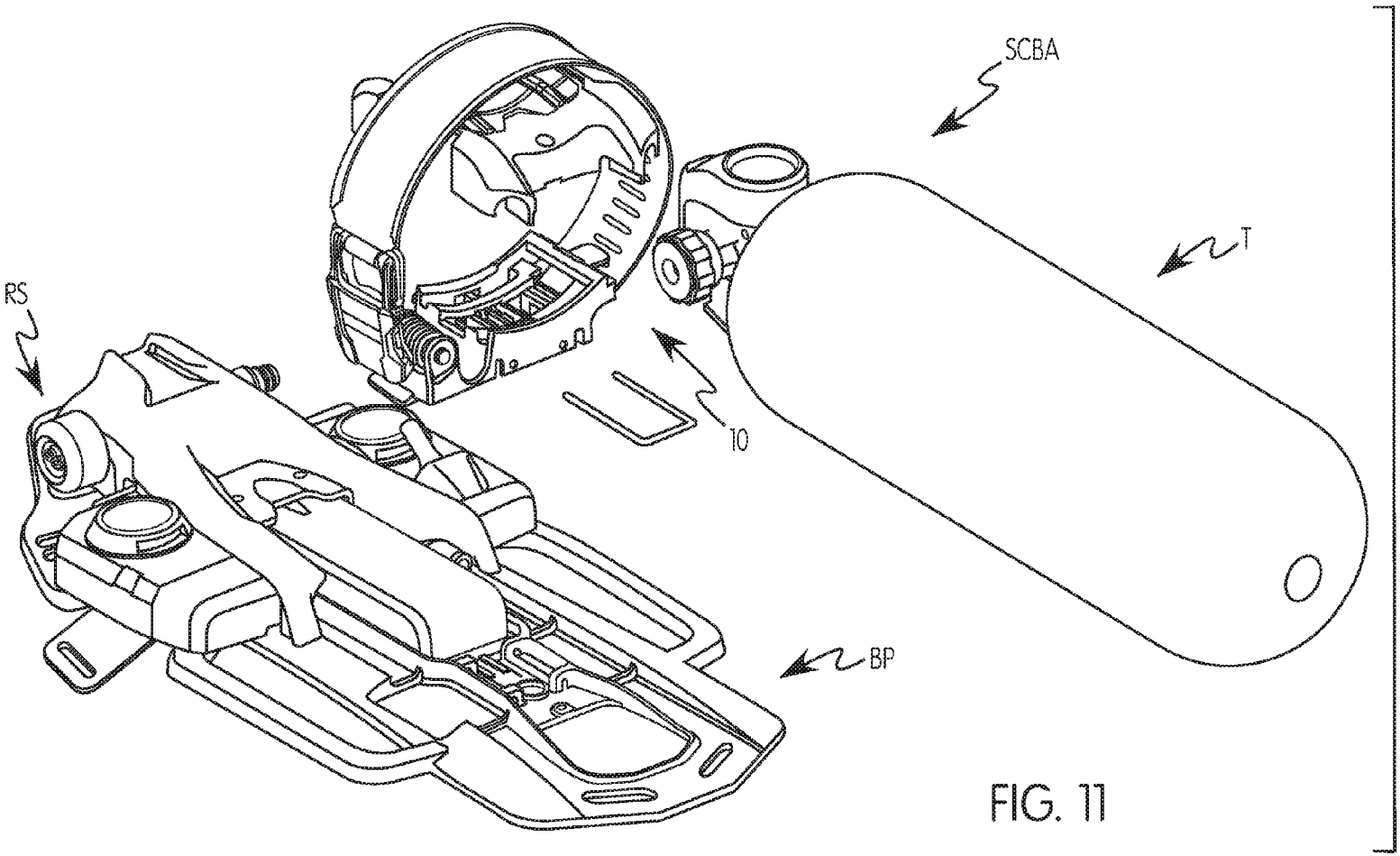
FIG. 11 is an exploded perspective view of a self-contained breathing apparatus including the tank attachment arrangement of FIG. 2.
Figure 12:
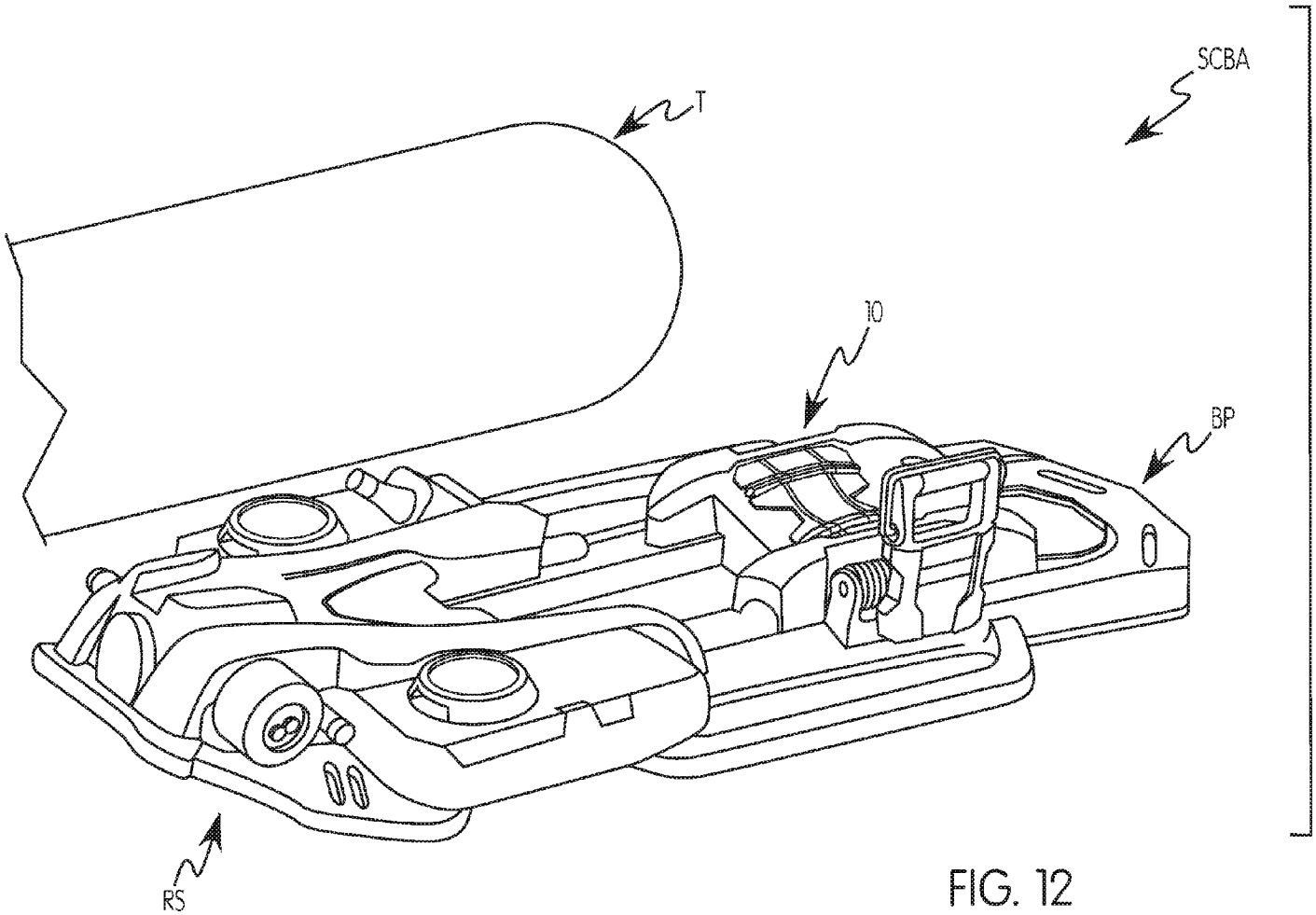
FIG. 12 is a perspective view of a self-contained breathing apparatus including the tank attachment arrangement of FIG. 2.

In one preferred and non-limiting embodiment, the attachment extension 56 includes a shaft 64, e.g., a cylindrical member, with a cap 66 on an end thereof. The cap 66 may be rounded, flat, circular, bulbous, or the like. In one preferred and non-limiting embodiment, the cap 66 is in the form of a round button-type member. Further, the orifice 60 defines a conduit 68 that has a ledge 70. In this embodiment, the attachment extension 56 is made from a flexible, resilient, or deformable material, such that it can be compressed and urged into the conduit 68, where the cap 66 expands in the conduit 68 and abuts against or engages the ledge 70 of the conduit 68. This represents a "button-type" connection between the contact member 18 and the saddle portion 14. Such removable engagement between the contact member 18 and the saddle portion 14 facilitates the easy maintenance or replacement of the contact member 18. For example, if the contact member 18 is ripped, torn, broken, degraded, or otherwise becomes ineffective, it may be simply removed from the saddle portion 14 using the above-described "button-type" engagement. The contact member 18 as engaged with the saddle portion 14 is illustrated in FIG. 9. Of course, any other removable engagement arrangement is envisioned, and in another preferred and non-limiting embodiment, the contact member 18 is permanently attached to the saddle portion 14.

With reference to FIGS. 3 and 10-12, and in another preferred and non-limiting embodiment, the base member 12 includes a cradle 72 that is removably engageable with or permanently attached to the back-plate assembly (BP), such as a frame portion of the back-plate assembly (BP). In addition, a cradle cover 74 can be provided to cover or otherwise contain or envelope the cradle 72. In one preferred and non-limiting embodiment the saddle portion 14 is attached to or formed on at least a portion of the cradle cover 74.

In a further preferred and non-limiting embodiment, and as best seen in FIGS. 2-5, 10, and 11, the tank retainer arrangement 20 includes an elongate band 76 that is configured to be loosened with respect to and urged against the tank (T), which thereby urges the tank (T) against the saddle portion 14 of the tank attachment arrangement 10. Accordingly, this elongate band 76 is configured to be engaged, tightened, and/or loosened with respect to the tank (T), such as by using a latching/tensioning assembly 78 that is in operative engagement with at least a portion of the base member 12. Any suitable elongate band 76-latching/tensioning assembly 78 may be used without departing from the spirit and scope of the presently-claimed invention. For example, a tensioning buckle may be attached to the cradle 72 through an intermediate spring secured to a lug protruding from the cradle 72. The elongate band 76 may be attached to the tensioning buckle such that, with a tank (T) placed against the saddle portion 14, the tensioning buckle is operated to secure the band 76 tightly around the tank (T).

In another preferred and non-limiting embodiment, at least a portion of the contact side 16 of the saddle portion 14 is formed from a frictional or gripping, e.g., "sticky" material, such as rubber material, a resilient material, a synthetic material, or the like. In this manner, the user (U) is able to slide the tank (T) on and along the contact members 18 to the appropriate position. Once in position, the user (U) uses the tank retainer arrangement 20 (e.g., the elongate band 76-latching/tensioning assembly 78) to urge the tank (T) towards and against the contact side 16 of the saddle portion 14. By forming at least a portion of the contact side 16 with a frictional or gripping material, and after actuating or operating the tank retainer arrangement 20, the tank (T) is more securely held in place against the base member 12, where the frictional or gripping material prevent or reduce any lateral movement of the tank (T). Accordingly, the tank attachment arrangement 10 provides a beneficial "slide and clamp" functionality.

With reference to FIGS. 2-5, and in another preferred and non-limiting embodiment, the contact side 16 of the saddle portion 14 includes or is in the form of a saddle contact member 80, which is either formed on or attached to an upper surface 82 of the base member 12, such as by some mutually interacting arrangement 83 (see FIG. 5) for connection of the saddle contact member 80 to the upper surface 82 of the base member 12. In this embodiment, it is the saddle contact member 80 that is either wholly or partially formed with the above-discussed frictional or gripping material.

In addition, and as illustrated in FIGS. 2-5, the saddle contact member 80 may include a central saddle contact portion 84 and two side saddle contact portions 86, all of which may be spaced, such as by the grooves 14. In addition, at least a portion of the saddle contact member 80, the central saddle contact portion 84, and/or the side saddle contact portions 86 may be shaped or configured for appropriate contact and engagement with a side surface of the tank (T). In particular, and in one preferred and non-limiting embodiment, the saddle contact member 80, including the central saddle contact portion 84 and/or the side saddle contact portions 86, are provided with the above-discussed first sloped portion 50, linear portion 52, and/or second sloped portion 54. This assists in facilitating the above-discussed "slide and clamp" functionality.

In addition, by providing both the central saddle contact portion 84 and the side saddle contact portions 86, various tank (T) sizes may be effectively accommodated. For example, a larger diameter tank (T) primarily, exclusively, or initially would contact the side saddle contact portions 86 upon positioning and actuation or operation of the tank retainer arrangement 20 (e.g., the elongate band 76-latching/tensioning assembly 78), and a smaller diameter tank (T) would primarily, exclusively, or initially contact the central saddle contact portion 84 upon positioning and actuation or operation of the tank retainer arrangement 20. These specially-configured contact points or areas may also be formed from or coated with the above-discussed frictional or gripping material.

In this manner, provided is a tank attachment arrangement 10 for a self-contained breathing apparatus (SCBA) that facilitates the quick attachment and removal of a tank (T) to and from the back-plate assembly (BP) of the self-contained breathing apparatus (SCBA). In addition, the tank attachment arrangement 10 provides a low-friction surface for the insertion and removal of the tank (T) to and from the tank attachment arrangement 10. In addition, the tank attachment arrangement 10 allows for the proper positioning of the tank (T) in connection with the tank attachment arrangement 10 or base member 12. This allows the end user (U) to rapidly change-out tanks T in the operating environment. In addition, by using the above-discussed contact members 18 and saddle portion 14, an improved bottom loading action is provided, and further, the "floating" contact members 18 will effectively depress and provide maximum contact with the saddle portion 14, e.g., the saddle contact member 80, thereby ensuring that the tank (T) does not move while clamped on the base member 12.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A tank attachment arrangement for a self-contained breathing apparatus having at least one tank, comprising:

a base member having a saddle portion comprising a contact side having at least one contact member directly or indirectly attached thereto, the at least one contact member configured to contact a surface of the at least one tank; and at least one tank retainer arrangement configured to retain the at least one tank with respect to the base member;

wherein the at least one contact member extends into a groove within the contact side of the saddle portion in a depth direction of the base member, and wherein the at least one contact member comprises a substantially linear portion, a first sloped portion, and a second sloped portion extending from opposing ends of the substantially linear portion in a longitudinal direction of the at least one contact member and substantially parallel with a longitudinal axis of the at least one tank to facilitate engagement or disengagement of the at least one tank with at least one of the substantially linear portion, the first sloped portion, and the second sloped portion of the tank attachment arrangement.

2. The tank attachment arrangement of claim 1, wherein the at least one contact member comprises a tip area having a thickness at a distal end thereof that is less than or substantially equal to the depth of the groove or less than or substantially equal to the thickness of the saddle portion.

3. The tank attachment arrangement of claim 1, wherein at least one of the first sloped portion, the linear portion, and the second sloped portion of the at least one contact member comprises a first sloped area and a second sloped area, the first sloped area and the second sloped area having a different degree of slope.

4. The tank attachment arrangement of claim 1, wherein the at least one contact member extends substantially from a first edge of the contact side of the saddle portion to a second edge of the contact side of the base member.

5. The tank attachment arrangement of claim 1, wherein the at least one contact member has a cross section that is at least one of the following: rounded, at least partially sloped, at least partially angled, substantially triangular, substantially in the form of a truncated triangle, beveled, or any combination thereof.

6. The tank attachment arrangement of claim 1, wherein the at least one contact member is formed from or coated with at least one of the following: an elastic material, a flexible material, a resilient material, a rubber material, a synthetic material, a plastic material, a silicon material, a low-friction material, or any combination thereof.

7. The tank attachment arrangement of claim 1, wherein the contact side of the saddle portion is substantially concave.

8. The tank attachment arrangement of claim 1, wherein the contact side of the saddle portion comprises at least one saddle contact member configured for contact with at least a portion of the at least one tank upon actuation or operation of the at least one tank retainer arrangement.

9. The tank attachment arrangement of claim 1, further comprising two spaced contact members that are configured to respectively contact two different areas of the surface of the at least one tank.

10. The tank attachment arrangement of claim 1, further comprising at least one groove extending along the contact side of the saddle portion of the base member, wherein the at least one contact member comprises at least one attachment extension extending from a bottom surface of the at least one contact member.

11. The tank attachment arrangement of claim 10, wherein the at least one groove comprises at least one orifice extending therethrough configured to at least partially receive and retain the at least one attachment extension, thereby attaching the at least one contact member to the saddle portion.

12. The tank attachment arrangement of claim 1, wherein the base member comprises:

a cradle attachable to a frame of a back-plate assembly of the self-contained breathing apparatus; and a cradle cover engageable with the cradle;

wherein the saddle portion is attached to or formed on the cradle cover.

13. The tank attachment arrangement of claim 1, wherein the at least one tank retainer arrangement comprises at least one elongate band configured to retain the at least one tank against the contact side of the saddle portion of the base member.

14. The tank attachment arrangement of claim 13, wherein the at least one elongate band is configured to be tightened and loosened with respect to the at least one tank.

15. The tank attachment arrangement of claim 14, wherein the at least one elongate band is configured to be tightened and loosened using a latching/tensioning assembly in operative engagement with at least a portion of the base member.

16. In a self-contained breathing apparatus having a back-plate assembly configured to be removably attached to a user and at least one tank having gas therein, a tank attachment arrangement comprising:

a base member having a saddle portion comprising a contact side having at least one contact member directly or indirectly attached thereto, the at least one contact member configured to contact a surface of the at least one tank; and at least one tank retainer arrangement configured to retain the at least one tank with respect to the base member;

wherein the at least one contact member extends into a groove within the contact side of the saddle portion in a depth direction of the base member, and wherein the at least one contact member comprises a substantially linear portion, a first sloped portion, and a second sloped portion extending from opposing ends of the substantially linear portion in a longitudinal direction of the at least one contact member and substantially parallel with a longitudinal axis of the at least one tank to facilitate engagement or disengagement of the at least one tank with at least one of the substantially linear portion, the first sloped portion, and the second sloped portion of the tank attachment arrangement.

17. A self-contained breathing apparatus, comprising:

a back-plate assembly having at least one attachment arrangement configured to removably connect the back-plate assembly to a user;

at least one tank having gas therein;

a regulation system directly or indirectly connected to the at least one tank and configured to provide regulated gas from the at least one tank to a mask of the user; and a tank attachment arrangement comprising:

(i) a base member having a saddle portion comprising a contact side having at least one contact member directly or indirectly attached thereto, the at least one contact member configured to contact a surface of the at least one tank; and (ii) at least one tank retainer arrangement configured to retain the at least one tank with respect to the base member;

wherein the at least one contact member extends into a groove within the contact side of the saddle portion in a depth direction of the base member, and wherein the at least one contact member comprises a substantially linear portion, a first sloped portion, and a second sloped portion extending from opposing ends of the substantially linear portion in a longitudinal direction of the at least one contact member and substantially parallel with a longitudinal axis of the at least one tank to facilitate engagement or disengagement of the at least one tank with at least one of the substantially linear portion, the first sloped portion, and the second sloped portion of the tank attachment arrangement.

18. The self-contained breathing apparatus of claim 17, wherein the at least one tank retainer arrangement comprises at least one elongate band configured to retain the at least one tank against the contact side of the saddle portion of the base member.

19. A tank attachment arrangement for a self-contained breathing apparatus having at least one tank, the tank attachment arrangement comprising:

a base member having a saddle portion comprising a contact side made from a first material;

at least one contact member disposed within a groove extending in a longitudinal direction of the contact side and substantially parallel with a longitudinal axis of the at least one tank, the at least one contact member made from a second material; and at least one tank retainer arrangement configured to retain the at least one tank with respect to the contact side and the at least one contact member, the at least one tank retainer arrangement movable between a first position and a second position, wherein the first material has a higher coefficient of friction than the second material, wherein, in the first position, the at least one tank is movable relative to the base by sliding along the at least one contact member, and wherein, in the second position, the at least one tank is clamped against the at least one contact member and the contact side.

20. The tank attachment arrangement of claim 19, wherein the at least one contact member comprises a substantially linear portion, a first sloped portion, and a second sloped portion extending from opposing ends of the substantially linear portion in a longitudinal direction of the at least one contact member and substantially parallel with the longitudinal axis of the at least one tank.

21. The tank attachment arrangement of claim 19, wherein the first material is a rubber material, a resilient material, or a high-friction material.

22. The tank attachment arrangement of claim 19, wherein the second material is an elastic material, a flexible material, a resilient material, a rubber material, a synthetic material, a plastic material, a silicon material, a low-friction material, or any combination thereof.

* * * * *